US008069804B2

(12) United States Patent
De Baan

(10) Patent No.: US 8,069,804 B2
(45) Date of Patent: Dec. 6, 2011

(54) DISCONNECTABLE TURRET MOORING SYSTEM FOR A VESSEL

(75) Inventor: Jacob De Baan, Maassluis (NL)

(73) Assignee: Bluewater Energy Services B.V., Hoofddorp (NL)

( * ) Notice: Subject to any disclaimer, the term of this patent is extended or adjusted under 35 U.S.C. 154(b) by 24 days.

(21) Appl. No.: 12/124,491

(22) Filed: May 21, 2008

(65) Prior Publication Data

US 2008/0289559 A1 Nov. 27, 2008

(30) Foreign Application Priority Data

May 24, 2007 (GB) ..... 0710031.6

(51) Int. Cl.
*B63B 21/00* (2006.01)

(52) U.S. Cl. ..... 114/230.12

(58) Field of Classification Search ..... 114/230.1, 114/230.12, 230.2–230.3; 441/3, 4
See application file for complete search history.

(56) References Cited

U.S. PATENT DOCUMENTS 5,240,446 A * 8/1993 Boatman et al. ..... 441/3
5,372,531 A * 12/1994 Boatman et al. ..... 441/4
5,782,197 A * 7/1998 Pollack ..... 114/230.12
5,860,382 A * 1/1999 Hobdy ..... 114/230.15
6,477,974 B2 * 11/2002 Hobdy ..... 114/230.12
2004/0261682 A1 12/2004 Lindblade
2007/0155259 A1 7/2007 Van Tol

FOREIGN PATENT DOCUMENTS

JP 61155086 A 7/1986

OTHER PUBLICATIONS

Official Search Report of the UK Patent Office in counterpart foreign application No. GB0710031.6 filed May 24, 2007.

* cited by examiner

*Primary Examiner* — Daniel Venne
(74) *Attorney, Agent, or Firm* — Steven M. Koehler; Westman, Champlin & Kelly, PA

(57) ABSTRACT

A disconnectable turret mooring system for a vessel is provided, comprising a turret positioned in a moonpool of the vessel and having an upper part cooperating with a first upper bearing assembly positioned between the turret and the vessel, and a lower disconnectable buoy part cooperating with a second lower bearing assembly positioned between the turret and the vessel, wherein the lower bearing assembly comprises a number of discrete circumferentially spaced bearing members which are attached to and extend radially inwards from the vessel for engaging the lower disconnectable buoy part of the turret, and which bearing members are displaceable radially between an inner operative position for engaging the lower disconnectable buoy part and an outer inoperative position for disengaging the lower disconnectable buoy part.

9 Claims, 4 Drawing Sheets

DISCONNECTABLE TURRET MOORING SYSTEM FOR A VESSEL

BACKGROUND

The discussion below is merely provided for general background information and is not intended to be used as an aid in determining the scope of the claimed subject matter.

The invention relates to a disconnectable turret mooring system for a vessel. Vessels (such as tankers) fitted with a disconnectable turret mooring system are frequently employed in the offshore oil industry. A disconnectable turret mooring system typically allows a buoy to be released from the remaining turret part when environmental conditions may pose an unacceptable hazard to the vessel in which the mooring system is fitted. The buoy is the part of the mooring system that is anchored to the seabed and which supports all risers. Typically, upon release from the remaining turret part, the buoy sinks to a pre-determined level. For again connecting the buoy to the remaining turret part, it is picked up by an appropriate device and again connected with the remaining turret part.

Vessels with disconnectable turret mooring systems are increasingly being employed in deeper water and need to carry an increasing number of risers. This requires a buoy with increasingly large dimensions in order to support the weight of the anchor lines and risers. This in turn also requires the turret structure to be large to be able to receive such a large buoy.

US patent application 2004/0261682 discloses a disconnectable turret mooring system for a vessel, comprising a turret positioned in the moonpool of the vessel and having an upper part cooperating with a first upper bearing assembly positioned between the turret and the vessel, and a lower disconnectable buoy part cooperating with a second lower bearing assembly positioned between the turret and the vessel. The lower bearing assembly according to this document comprises a bearing ring positioned between the buoy and the vessel. This known disconnectable turret mooring system however is not suitable for buoys with large diameter because relatively tight tolerances are required to obtain a reasonable fit between the buoy and the bearing ring. Moreover, to prevent a relative rotation between the buoy and a reaction ring engaging the bearing ring it is suggested to provide means such as pins cooperating with corresponding slots. This makes the structure complicated. Further for ensuring a proper cooperation between such pins and corresponding slots a good alignment during hook up of the buoy is required. Finally, it is a disadvantage of this known mooring system that mounting the lower bearing assembly is complicated.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

In accordance with one aspect of the present invention, a disconnectable turret mooring system for a vessel is provided comprising a turret positioned in a moonpool of the vessel and having an upper part cooperating with a first upper bearing assembly positioned between the turret and the vessel, and a lower disconnectable buoy part cooperating with a second lower bearing assembly positioned between the turret and the vessel, wherein the lower bearing assembly comprises a number of discrete circumferentially spaced bearing members which are attached to and extend radially inwards from the vessel for engaging the lower disconnectable buoy part of the turret, and which bearing members are displaceable radially between an inner operative position for engaging the lower disconnectable buoy part and an outer inoperative position for disengaging the lower disconnectable buoy part.

As a result of the provision of a number of discrete circumferentially spaced bearing members which are displaceable radially as stated above, a lower bearing assembly is provided that is much simpler to adjust to tight tolerances and of which the mounting is much simpler. In the outer inoperative position of the bearing members the lower bearing assembly does not define a contact between the buoy and vessel, such that the disconnect or hook-up operation of the buoy can be carried out in an easy manner.

The disconnectable turret mooring system is particularly suitable in cases where a very large disconnectable buoy is needed, typically requiring a diameter of the lower bearing assembly of eight meters or more.

In one embodiment, the lower disconnectable buoy part is provided with an outer bearing ring for cooperation with the bearing members. Such a bearing ring not only protects the buoy against wear, but also can reinforce the buoy at the location where the bearing members engage. Such a bearing ring may be replaced when needed.

The bearing ring can include an upper inwardly sloping part, making entrance of such a bearing ring between the bearing members very easy.

In accordance with another embodiment of the disconnectable turret mooring system it comprises eighteen bearing members which are regularly spaced at 20° intervals. However, it is noted that also any other number of discrete bearing members may be applied.

According to yet another embodiment, each bearing member comprises a longitudinal member having an inner end defining a bearing surface for cooperation with the lower disconnectable buoy part and a shaft part extending outwardly from said inner end and cooperating with a stationary guide connected to the vessel, and further comprises a drive mechanism or actuator for displacing the shaft part relative to the stationary guide between the inner operative position and the outer inoperative position. The bearing surface will cooperate with the buoy, for example the bearing ring if applied. The shaft part not only carries said bearing surface, but also serves as part for cooperating with the stationary guide.

Although is it possible, in another embodiment, that each bearing member is operated manually, the drive mechanism can comprise remotely operated automated drive devices, such as for example electrically, hydraulically or pneumatically operated drive devices. For example, the shaft part could comprise the piston rod of a cylinder-piston assembly.

According to another embodiment, the moonpool has a lower end in which fender members are provided for cooperation with the turret. Such fender members, which may comprise a number of circumferentially spaced fender strips, may be made of rubber or plastic material. The objective of such fender members is to prevent damage to the bearing surface of the turret at the location of the lower bearing (such as the bearing ring mentioned before).

Finally an embodiment is mentioned, in which the moonpool has a lower end at the keel of the vessel and wherein the second lower bearing assembly is positioned at a distance above said lower end of the moonpool. Such a position of the second lower bearing assembly prevents it from being subjected to hogging and sagging deformations of the vessel.

BRIEF DESCRIPTION OF THE DRAWINGS

Hereinafter the invention will be elucidated while referring to the drawing, in which an embodiment of a disconnectable turret mooring system for a vessel is illustrated. Herein

DETAILED DESCRIPTION

Figure 1:
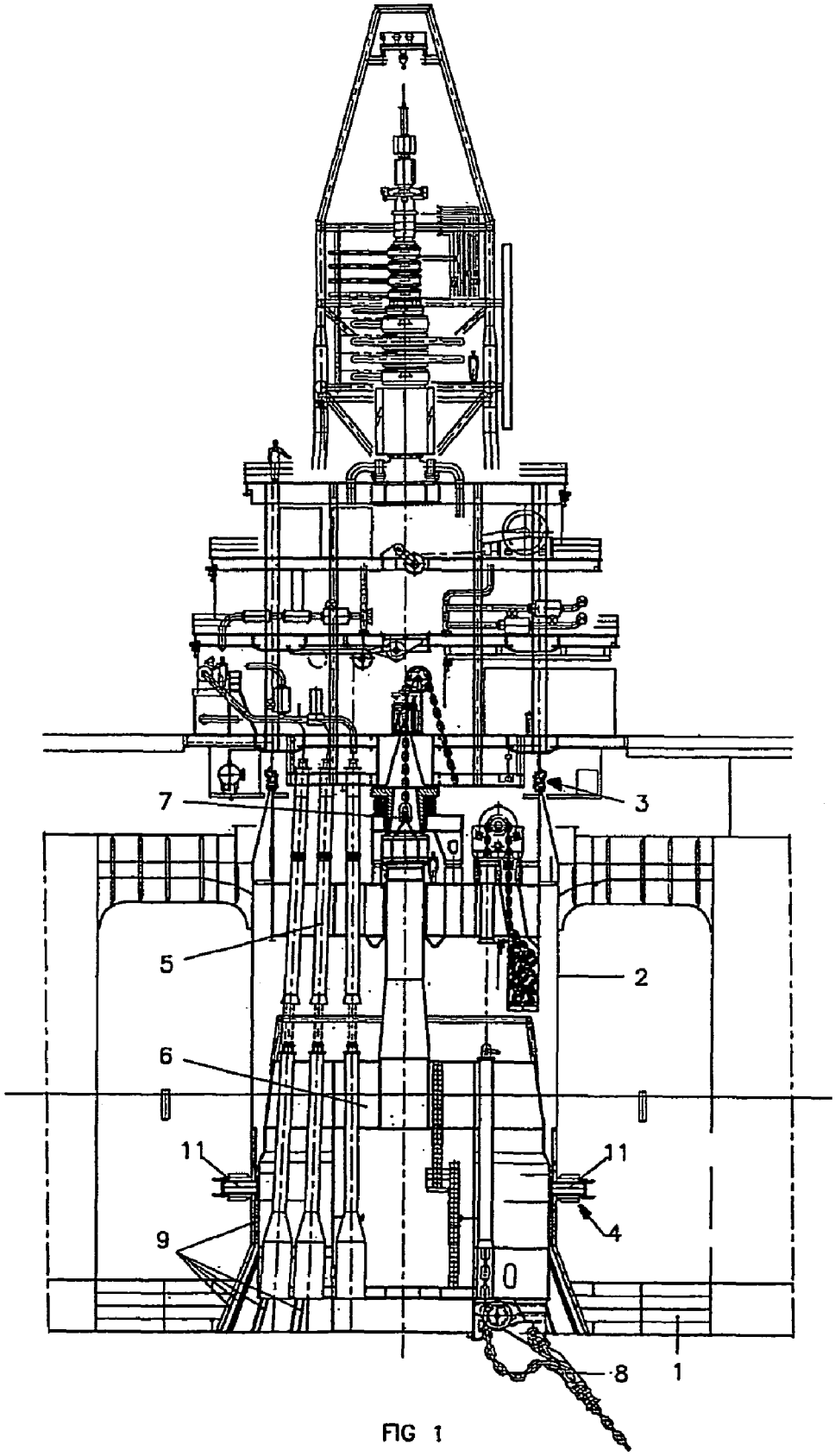
FIG. 1 shows, schematically and in cross section an embodiment of a disconnectable turret mooring system according to the present invention.

Firstly referring to FIG. 1 an overall layout of a disconnectable turret mooring system having one or more aspects of to the present invention is shown. In the hull 1 of a vessel, a moonpool 2 is defined in which a first upper bearing assembly 3 and second lower bearing assembly 4 are provided. The moonpool 2 receives, as is known per se, a turret comprising an upper part 5 and a lower disconnectable buoy part 6.

The first upper bearing assembly 3 is positioned between the upper part of the turret 5 and the inner wall of the moonpool 2, whereas the second lower bearing assembly 4 is positioned between the lower disconnectable buoy part 6 of the turret and the inner wall of the moonpool 2.

The lower disconnectable buoy part 6 of the turret is supported from the upper part 5 by a suitable disconnectable arrangement 7, the details of which are known from the state of the art and thus are not any further elaborated here. Further, as is known per se, the lower disconnectable buoy part 6, which typically is located largely below the waterline, consists mainly of a plurality of buoyancy tanks (not indicated). Anchoring means, such as anchor chains 8, are attached near the lower end of the disconnectable buoy part 6. Further, risers (not indicated) will extend from the lower buoy part 6 downwardly and upwardly.

For disconnecting and connecting the disconnectable buoy part 6 to the upper part 5 of the turret, a hoist and latch(es) may be provided, which also are known from the state of the art and thus are not elucidated here. For example, one version of latches is illustrated and described in co-pending application Ser. No. 11/617,948, filed Dec. 29, 2006 and entitled "Disconnectable Mooring System for a Vessel", the content of which is hereby incorporated by reference in its entirety.

The lower bearing assembly 4 comprises a number of discrete circumferentially spaced bearing members 11 which are attached to and extend radially inwards from the vessel 1 for engaging the lower disconnectable buoy part 6 of the turret.

Figure 3:
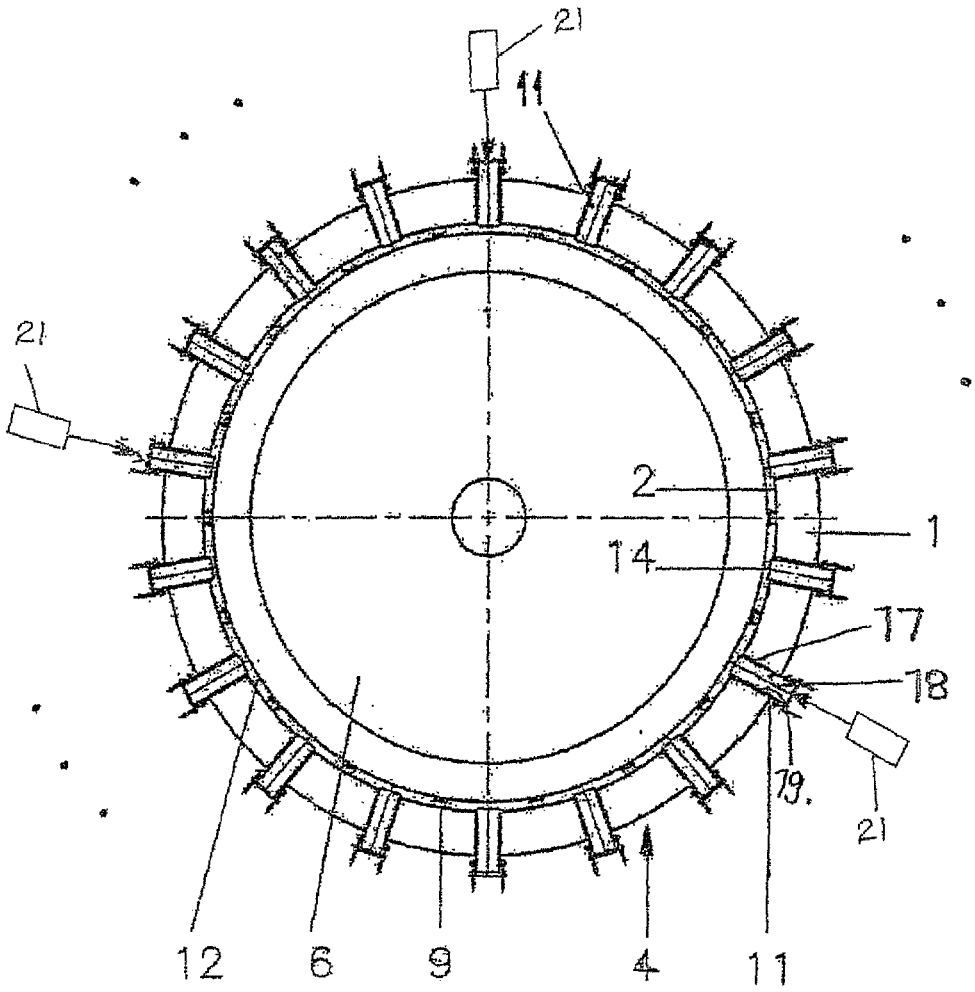
FIGS. 3 and 4 show the operation of bearing members.
Figure 4:
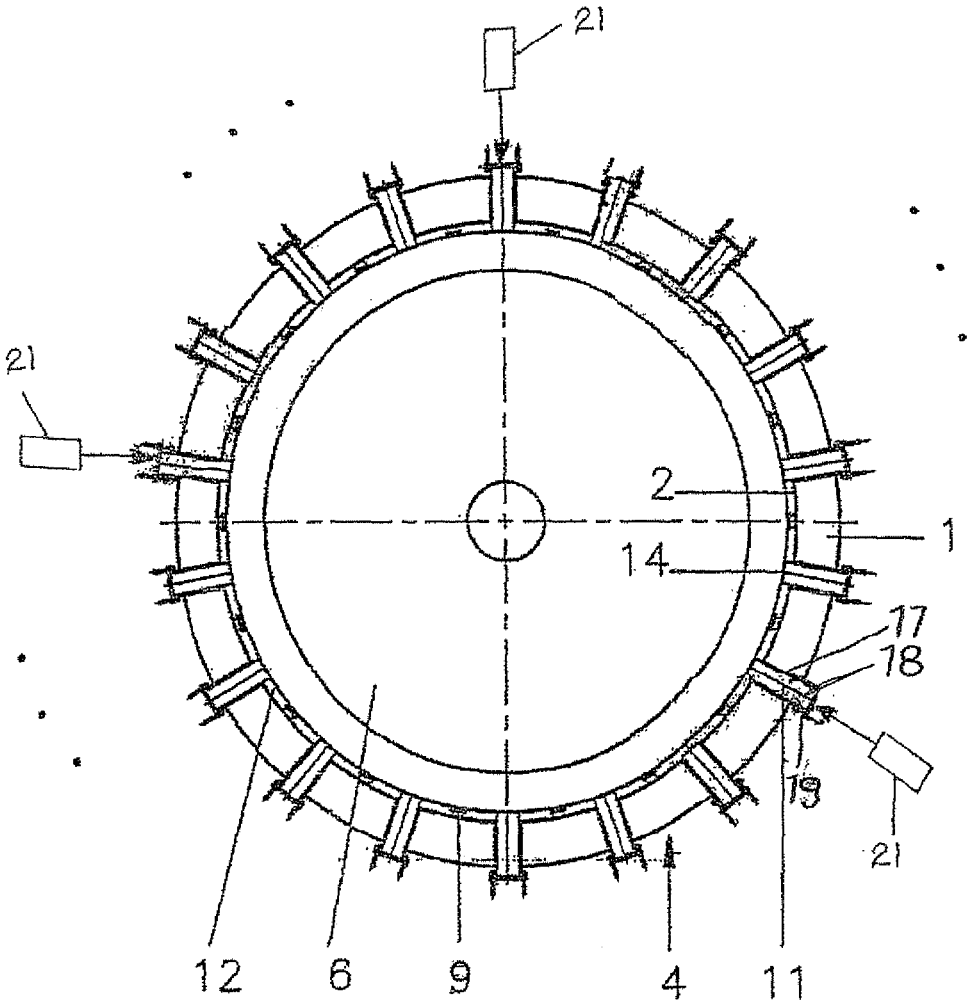

As shown, for example and without limitation, in FIGS. 3 and 4 the lower bearing assembly 4 can comprise eighteen bearing members 11 which are regularly spaced at 20° intervals.

Figure 2:
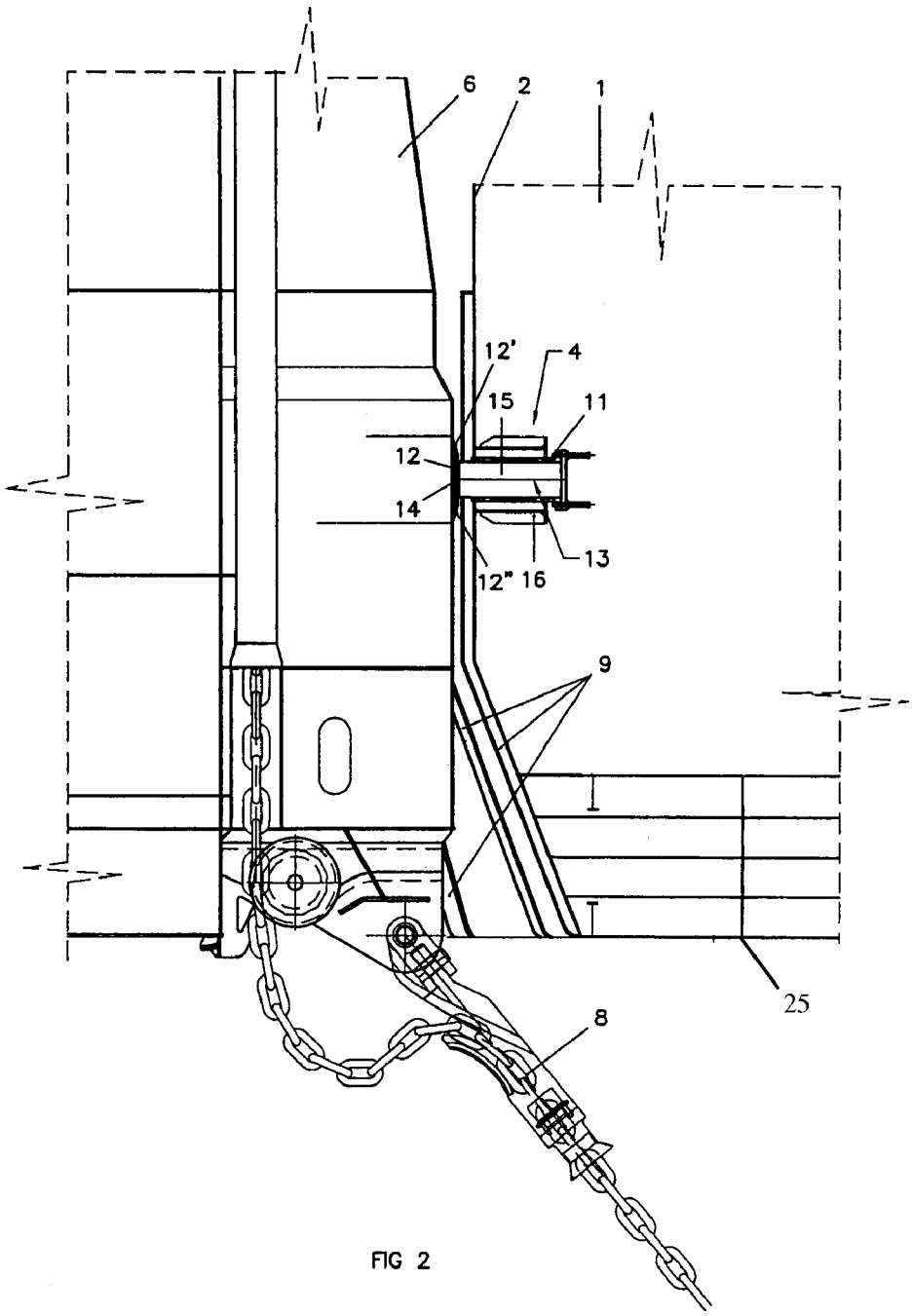
FIG. 2 illustrates, on a larger scale, a detail of the mooring system of FIG. 1.

Referring to FIG. 2, part of the disconnectable turret mooring system of FIG. 1 is shown on a larger scale, illustrating a bearing member 4. The lower disconnectable buoy part 6 is provided with an outer bearing ring 12 for cooperation with the bearing members 11. In the illustrated embodiment, the bearing ring has an upper and lower inwardly sloping part 12' and 12", respectively.

Each bearing member 11 comprises a longitudinal member 13 having an inner end 14 defining a bearing surface for cooperation with the bearing ring 12 of the lower disconnectable buoy part 6. The longitudinal member 13 further comprises a shaft part 15 extending outwardly from said inner end 14 where the shaft part 15 has an outer end 17 and cooperating with a stationary guide 16 which is connected to the vessel 1. A longitudinal axis 18 extends through the inner end 14 and the outer end 17 of the shaft part 15. The stationary guide 16 includes an aperture 19 through which the shaft part 15 moves along the longitudinal axis 18.

The inner end 14 of each bearing member 11 is displaceable radially along the longitudinal axis 18 between an inner operative position for engaging the lower disconnectable buoy part 6 and an outer inoperative position for disengaging said buoy part 6. The operative position is illustrated in FIG. 4, whereas the inoperative position is illustrated in FIG. 3.

Driving devices 21 for displacing the bearing members 11 (or, specifically, the shaft parts 15 thereof) between the operative and inoperative positions. Such driving devices may comprise remotely operated automated driving devices, such as for example electrically, hydraulically or pneumatically operated driving devices. For example, the driving devices can comprise an actuator(s). Although only three driving devices 21 are illustrated, it should be understood that additional driving devices 21 would be provided (represented by ellipses). Furthermore, the driving devices 21 can be configured so as to operate one or more bearing members 11. Without limiting the type of driving device 21 that can be used, by way of example driving device 21 can comprise a single acting or a double acting piston in corresponding cylinders. Likewise, screw operated actuators can be used. Cams or levers can also be used. It should also be noted that driving the bearing members 11 can also be effected manually.

It is noted, that all bearing members 11 may be displaced individually, such that the displacement among these bearing members 11 may differ one from the other.

When the disconnectable buoy part 6 has to be disconnected from the upper part 5 of the turret, the bearing members 11 are retracted outwardly to the inoperative position. When, however, the disconnectable buoy part 6 is connected to the upper part of the turret, the bearing members 11 are displaced towards to the operative position, in which the bearing surface 14 thereof engages the bearing ring 12 of the buoy part 6.

In the illustrated embodiment of the disconnectable turret mooring system, the moonpool 2 has a lower end (which, in the illustrated embodiment, widens in a downward direction) in which fender members 9 are provided for cooperation with the turret. Such fender members 9 may comprise a number of circumferentially spaced fender strips which may be made of rubber of a plastic material. The objective of these fender strips is to prevent any damage of the bearing surface of the bearing ring 12, which surface for instance can be made of stainless steel.

Further, referring to FIG. 2, it appears that the moonpool 2 has a lower end at the keel 25 of the vessel 1, wherein the second lower bearing assembly 4 is positioned at a distance above said lower end of the moonpool.

Although the subject matter has been described in language specific to certain compositions, structural features and/or methodological acts, it is to be understood that the subject matter defined in the appended claims is not necessarily limited to the specific compositions, features or acts described above as has been determined by the courts. Rather, the specific compositions, features and acts described above are disclosed as example forms of implementing the claims.

What is claimed is:

1. A disconnectable turret mooring system for a vessel, comprising a turret positioned in a moonpool of the vessel and having an upper part that engages a first upper bearing assembly positioned between the turret and the vessel, and a lower disconnectable buoy part that engages a second lower bearing assembly positioned between the turret and the vessel, wherein the lower bearing assembly comprises a plurality of discrete circumferentially spaced apart bearing members, wherein each bearing member comprises a shaft having an inner end and an outer end and a longitudinal axis that extends from the inner end to the outer end, wherein each bearing member moves along the longitudinal axis through an aperture in a stationary guide wherein each bearing member is movable toward the turret and into an operative position where the inner end causes a frictional engagement with the turret, and wherein each bearing member is movable away from the turret through the aperture in the stationary guide and along the longitudinal axis to an inoperative position such that the inner end is displaced from the turret, and a drive device coupled to each bearing member, wherein the drive device displaces the bearing member to each of the operative position and the inoperative position.

2. The disconnectable turret mooring system according to claim 1, wherein the lower disconnectable buoy part is provided with an outer bearing ring upon which the bearing members engage in the operative position.

3. The disconnectable turret mooring system according to claim 2, wherein the outer bearing ring has an upper inwardly sloping part.

4. The disconnectable turret mooring system according to claim 1 wherein the bearing members are regularly spaced 20° apart from each other circumferentially about the lower disconnectable buoy part.

5. The disconnectable turret mooring system according to claim 1, wherein each drive device comprises an actuator.

6. The disconnectable turret mooring system according to claim 1, wherein the moonpool has a lower end configured to receive the turret therein and includes fender members that engage the turret.

7. The disconnectable turret mooring system according to claim 6, wherein the fender members comprise a number of circumferentially spaced fender strips on the inwardly facing surface.

8. The disconnectable turret mooring system according to claim 1, wherein the moonpool has a lower end at the keel of the vessel and wherein the second lower bearing assembly is positioned at a distance above said lower end of the moonpool.

9. The disconnectable turret mooring system of claim 1 and wherein the bearing members move radially with respect to a central axis of the monopole and along each corresponding longitudinal axis between the operative position and the inoperative position.

* * * * *